United States Patent [19]

Moertel

[11] 4,265,190

[45] May 5, 1981

[54] SEWING AID FOR SLIDE FASTENER AND METHOD

[75] Inventor: George B. Moertel, Conneautville, Pa.

[73] Assignee: Textron Inc., Providence, R.I.

[21] Appl. No.: 911,570

[22] Filed: Jun. 1, 1978

[51] Int. Cl.[3] ..... D05B 3/12; D05B 35/06

[52] U.S. Cl. ..... 112/265.2; 2/265; 223/44

[58] Field of Search ..... 112/265.2, 104, 262.1, 112/153, 136; 2/265, 266; 33/174 B, 174 G, 2 R; 24/205.16 D; 223/44, 28, 34, 35

[56] References Cited

U.S. PATENT DOCUMENTS

| | | | |
|---|---|---|---|
| 3,286,669 | 11/1966 | Rockerath et al. | 112/265 |
| 3,348,509 | 10/1967 | Degraw | 112/265 |
| 3,444,598 | 5/1969 | Glindmeyer et al. | 112/265 X |
| 3,456,305 | 7/1969 | Voit | 112/265 X |
| 3,561,073 | 2/1971 | Rosser | 2/265 X |
| 3,977,581 | 8/1976 | Franzson | 223/44 |

*Primary Examiner*—Werner H. Schroeder
*Assistant Examiner*—Andrew M. Falik
*Attorney, Agent, or Firm*—O'Brien & Marks

[57] ABSTRACT

A guide including one or more members formed from planar material, such as paper, is removably attached to a slide fastener. Article edge portions bordering an opening in an article are removably attached to the guide. The guide retains the edge portions of the article in position relative to the slide fastener during sewing of the edge portions to the slide fastener.

81 Claims, 23 Drawing Figures

FIG.8
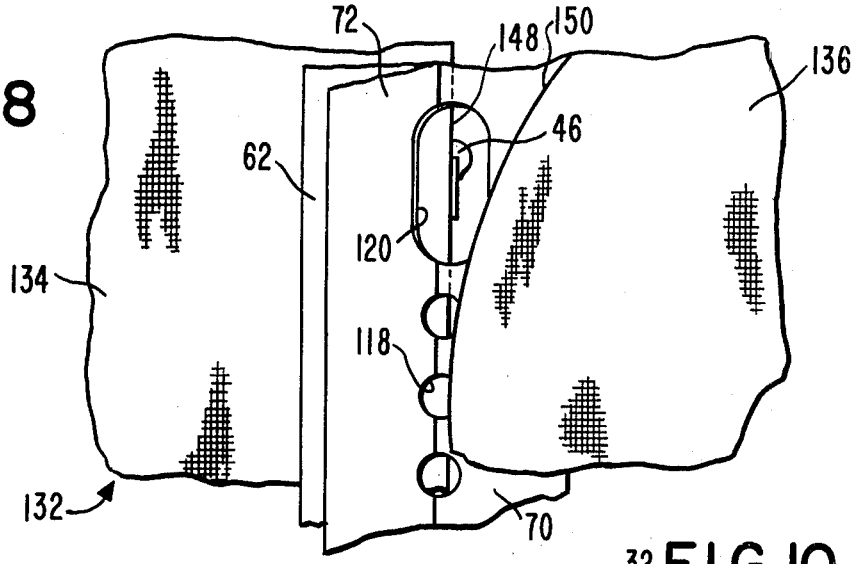
FIG.9
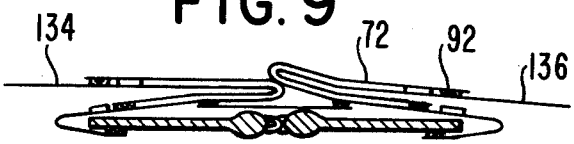
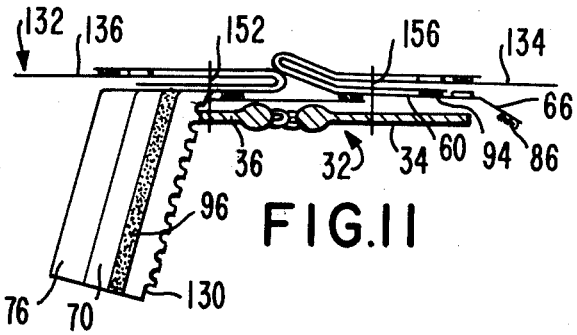
FIG.11
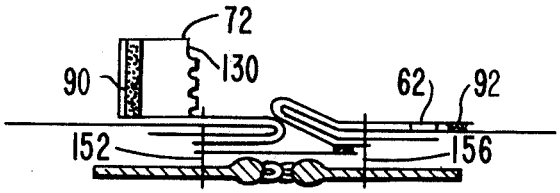
FIG.12
FIG.10
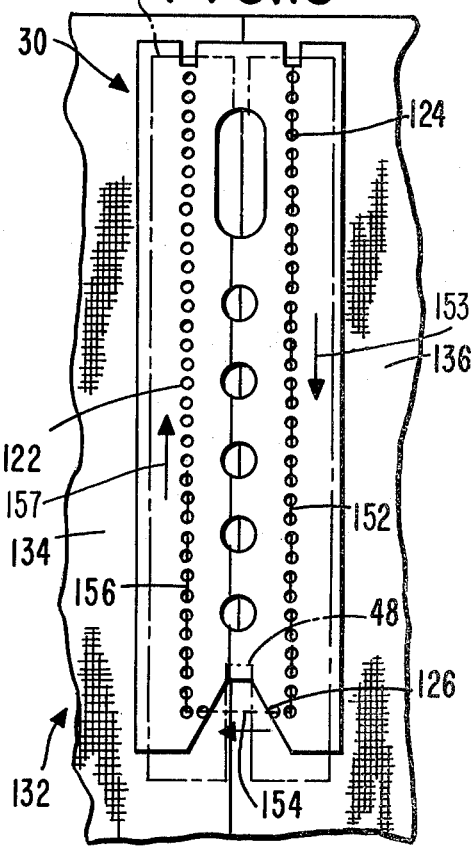
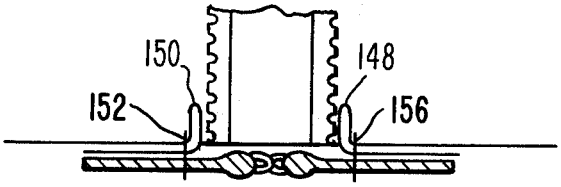
FIG.13

SEWING AID FOR SLIDE FASTENER AND METHOD

BACKGROUND OF THE INVENTION

1. Field of the Invention

This invention relates to aids and methods used in sewing slide fasteners to articles and particularly, to such aids and methods suitable for employment by relatively unskilled seamstresses.

2. Description of the Prior Art

In one prior art procedure for installing slide fasteners in a seam of a garment, the garment seam is initially sewn to the preferred bottom point of the opening in which the slide fastener is to be installed. The sewing machine is then adjusted to form a basting stitch and the opening is basted closed. This basting thread is clipped to render subsequent removal of the basting threads easy. The seam is pressed. A slide fastener is positioned over the basted seam opening and is sewn with a machine basting stitch to the article. After readjusting the stitching of the sewing machine, the slide fastener is sewn to the garment by sewing down the right side, across the bottom and up the left side of the slide fastener. The basting stitches are then removed and the installation of the slide fastener is complete. Besides requiring a number of difficult steps and procedures, this method of installing a slide fastener often results in a space between the opposite seam flaps overlying the slide fastener leaving the slide fastener exposed, particularly where the slider is positioned. Since the sewing occurs with the garment underneath, wrinkles or bunching of the garment material, particularly if relatively thin material, often results. Further, crooked sewing lines visible on the exterior of the garment and other defects are sometimes produced.

In another type of slide fastener installation method, as disclosed in U.S. Pat. No. 3,348,509 and a publication "Zippers" *The ABC's of Short Cut Sewing* Simplicity Pattern Company 1976 page 90, the basting of the slide fastener to the seam opening is eliminated and a plurality of strips of pressure sensitive adhesive tape are used to temporarily secure the slide fastener onto the garment. In this process the steps of sewing the seam to the bottom of the seam opening, adjusting the stitch setting of the sewing machine, basting the seam opening closed, and pressing the seam are still employed prior to positioning and taping of the slide fastener to the garment. Adhesive tape is positioned on the front surface of the garment to form a guide line for sewing the slide fastener to the garment. After sewing of the slide fastener, the adhesive tapes are removed as well as the basting stitches in the slide fastener opening. This method can still result in an opening being left between the seam flaps over the slide fastener, and other deficiencies.

SUMMARY OF THE INVENTION

The invention is summarized in a device for use in sewing a slide fastener to an article along an opening in the article, including a guide for extending along article edge portions bordering opposite sides of the opening in the article, means for removably attaching the guide to the slide fastener, and means for removably attaching the edge portions of the article to the guide to mount the slide fastener on the article in position to be sewn to the article.

An object of the invention is to make the sewing of a slide fastener to an article easier.

Another object of the invention is to eliminate basting, machine adjusting and basting stitch removing steps employed in prior art methods of installing a slide fastener.

It is yet another object of the invention to prevent scuffing of garment material during sewing.

A further object of the invention is to eliminate wrinkles in thin fabric material during sewing of a slide fastener to the fabric.

One advantage of the invention is that a sewing aid can be sold attached to a slide fastener and the aid can be used to position and install the slide fastener in a garment.

One feature of the invention is the provision of planar guide members foldable over article edge portions bordering an opening in an article for securing both the upper and lower surfaces of the edge portions to accurately retain the edge portions in position during sewing of a slide fastener to the article.

Another feature of the invention includes the provision of openings through folded members for permitting positioning of article edge portions bordering the opening of an article during attachment of a guide to enable the formation of an improved slide fastener installation.

Still another feature of the invention includes the provision of a notch on the bottom end of a guide for accurately positioning a slide fastener mounted on the guide relative to the bottom end of an opening in which the slide fastener is to be sewn.

A further feature of the invention concerns the provision of perforated lines which serve both as sewing guide lines and as tear lines in removing a guide after sewing.

A still further feature of the invention is the provision of an enlarged opening over the position of a slider enabling adjustment of article seam flaps to insure coverage of the slider when the slide fastener is in a closed condition.

Yet still another feature of the invention concerns the provision of a bridge member uniting two folded positioning members to form a unitary guide.

Yet still a further feature of the invention contemplates the overlap of inner folded edges of positioning members to insure that article edge flaps can be positioned to cover slide fastener elements.

An additional feature of the invention is the provision of easy-to-begin-tear slits on the upper end of a guide to enable the guide to be easily ripped from the garment after installation of a slide fastener.

In another additional feature of the invention, a guide and slide fastener, if attached to the guide, are made in one relatively long length which may be cut to accommodate article openings of shorter lengths.

In yet another additional feature of the invention, an extra length of slide fastener extending beyond a guide may be used for holding a slider during sewing and then cut off after the slider is mounted onto the sewn part of the slide fastener.

Other objects, advantages and features of the invention will be apparent from the following description of the preferred embodiments taken in conjunction with the accompanying drawings.

BRIEF DESCRIPTION OF THE DRAWINGS

FIG. 8 is a plan view illustrating the same step of FIG. 7.

FIG. 9 is a view similar to FIGS. 6 and 7 but after completion of the temporary attachment of the slide fastener in an article ready for sewing of the slide fastener to the article.

FIG. 10 is a plan view of the temporarily attached slide fastener and guide to FIG. 9 during the sewing operation.

FIG. 11 is a cross-section view taken from the top looking toward the bottom, i.e., opposite to the views of FIGS. 2, 3, 6, 7 and 9, during a first step in the removal in the guide from the permanently installed slide fastener and article.

FIG. 12 is a cross-section view similar to FIG. 11 but at a later step in the removal of the guide.

FIG. 13 is a view similar to FIGS. 11 and 12 but at still a later step in the removal of the guide from the article and slide fastener.

DESCRIPTION OF THE PREFERRED EMBODIMENTS

Figure 1:
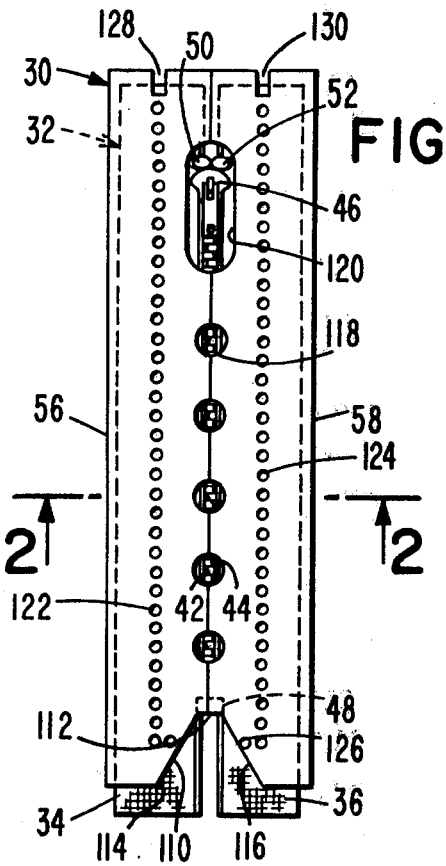
FIG. 1 is a plan view of a guide with attached slide fastener for installation in an article in accordance with the invention.
Figure 2:
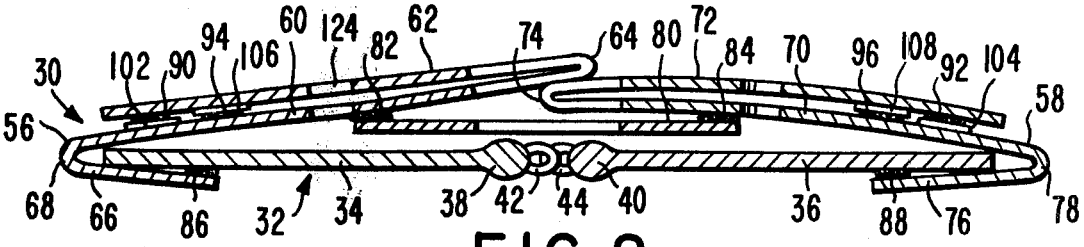
FIG. 2 is an enlarged cross-section view taken at line 2—2 in FIG. 1.

As shown in FIGS. 1 and 2, the invention is embodied in a guide generally indicated at 30 carrying a slide fastener generally indicated at 32. The slide fastener 32 is removably attached to the guide 30 and the guide 30 can be removably attached to an article to mount the slide fastener 32 on the article in position for being sewn to the article. The guide 30 and slide fastener 32 can be sold as a unit, or the guide 30 can be sold by itself and the purchaser can releasably attach a slide fastener to the guide 30 before installing in an article.

The slide fastener 32 is a conventional slide fastener including a pair of carrier tapes such as textile carrier tapes 34 and 36 having inner beaded edges 38 and 40 carrying respective coupling elements 42 and 44. A slider 46 is slidably mounted on the beaded edges 38 and 40 and coupling elements 42 and 44 for opening and closing the slide fastener. A bottom stop 48 is attached to the slide fastener 30 across the coupling elements 42 and 44 at the bottom end of the slide fastener for limiting downward movement of the slider 46 as well as securing the bottoms of the tapes 34 and 36 together. Top stops 50 and 52 are mounted at the upper ends of the respective coupling elements 42 and 44 for limiting upward movement of the slider 46. The coupling elements 42 and 44 are illustrated as being of the plastic filamentary coil type; however conventional slide fasteners with any other type of coupling element, such as filamentary ladder, plastic or metal molded elements, etc. can be used.

The guide 30 includes a left guide member 56 and a right guide member 58 which extend longitudinally along opposite sides of the slide fastener 32 substantially the entire length thereof. The members 56 and 58 are formed from planar material, such as paper, plastic or the like, which is flexible transverse to the plane thereof but is substantially inelastic or stable in dimensions extending in directions within the plane of the material. The planar material has a natural resilience against bending or folding except where score or hinge lines have been formed. Preferred materials for the members 56 and 58 are paper materials ranging in thickness from 0.127 millimeters (0.005 inches) to 0.21 millimeters (0.008 inches); one suitable material at the lower end of the preferred range of paper material is known as "ledger bond" and another suitable material at the upper end of the preferred range is 90 lb. index paper. Thinner papers may be used; however very thin paper material bends to be too flexible and not hold the slide fastener in position. Thicker paper material may also be used, however excessively thick materials interfere with sewing as well as being too inflexible and too costly.

The left guide member 56 includes a center panel 60, a top flap 62 hinged at a score line 64 on the right or inner edge of the center panel 60, and a bottom flap 66 hinged at a score line 68 on the left or outer edge of the center panel 60; and the right guide member 56 includes a center panel 70, a top flap 72 hinged at a score line 74 on the left or inner edge of the center panel 70, and a bottom flap 76 hinged at a score line 78 on the right or outer edge of the center panel 70. A bridge member 80 is formed of a strip of material similar to the members 56 and 58. The width of the bridge member 80 is a little less than the desired spacing between stitching lines attaching the tapes 34 and 36 to an article, and the length of the member 80 is the same as the lengths of members 56 and 58. The members 56 and 58 are both secured to the bridge member 80, such as by strips 82 and 84 of conventional paper adhesive bonding outer edge portions of the upper surface of bridge member 80 to intermediate portions of the bottom surfaces of the respective central panels 60 and 70 to form a unitary guide. Any other securing or bonding means may be used in place of the adhesive strips 82 and 84.

Folded edge portions of the panel 60 and the flap 62 adjacent the crease 64 overlie folded edge portions of the panel 70 and flap 72 adjacent the crease line 74 directly over the coupling elements 42 and 44. This overlap is selected to be sufficient to permit an edge portion of an article to be inserted on the central panel 70 underneath the flap 72 directly in alignment with the edge of an opposite edge portion of the article inserted within the member 56 over the panel 60 underneath the flap 62.

The panels 60 and 70, the member 80, and the top flaps 62 and 72 overlie the slide fastener 32. The bottom flaps 66 and 76 are folded downward from the outer edges of the guide 30 underneath the outer edges of the tapes 34 and 36 of the slide fastener 32. Longitudinal adhesive strips 86 and 88 on the inner edge portions of the upper surfaces of the flaps 66 and 76 releasably attach the tapes 34 and 36 of the slide fastener 32 to the flaps 66 and 76. Longitudinal adhesive strips 90 and 92 are secured to outer portions of the bottom surfaces of the respective top flaps 62 and 72 while longitudinal adhesive strips 94 and 96 are mounted on the top surfaces of the respective central panels 60 and 70 spaced slightly inward from the strips 90 and 92. These strips 86, 88, 90, 92, 94 and 96 extend the full length of the guide 30.

The adhesive strips 86, 88, 90, 92, 94 and 96 are suitable pressure-sensitive adhesive strips which are formed from commercial extrudable adhesive materials by extruding in strips onto the guide 30. It is preferred that the adhesive material in the strips 86 and 88 be a relatively tenacious material, particularly when the guide 30 and slide fastener 32 are sold as a unit, to avoid detachment of the slide fastener 32 from the guide during shipping, storing and handling. The adhesive material in the strips 90, 92, 94 and 96 is preferably selected to have relatively less tenacity to avoid damage to delicate garment materials, such as velvet, to which the strips are to be releasably attached. Any other suitable adhesive material or combination of adhesive materials or any other attaching means which permits release and removal of the guide 30 from an article and the slide fastener 32 may be used in place of the extruded strips 86, 88, 90, 92, 94 and 96.

Release coatings or strips 102 and 104 are formed by depositing a commercial silicone release material on the upper surface of the central panel 60 directly beneath the respective adhesive strips 90 and 92 to cover and protect the adhesive strips 90 and 92 while release coatings or strips 106 and 108 are similarly formed on the bottom surface of the top flaps 62 and 72 directly over the respective adhesive strips 94 and 96 to cover and protect the adhesive strips 94 and 96 as well as permitting easy release of the top flaps 62 and 72. When the guide 30 is sold separate from the slide fastener 32, similar release coatings or strips (not shown) are formed on the bottom surface of the central panel 60 directly over the adhesive strips 86 and 88 for covering and protecting the adhesive strips 86 and 88.

A notch 110 is formed in the lower end of the guide 30 centrally between the opposite sides thereof. This notch 110 extends through the flaps 62 and 72 as well as the central panels 60 and 70 and the bridging panel 80. The notch 110 has an upper edge 112 extending perpendicular to the guide 30 and the slide fastener 32 across the center of the guide 30 and slide fastener 32 and has side edges 114 and 116 extending outwardly and downwardly from the ends of the edge 112.

A plurality of openings or windows 118 extend through the inner folded edge portions of the flaps 62 and 72 and the panels 60 and 70 as well as the bridge panel 80 directly over the coupling elements 42 and 44. These openings 118 are spaced longitudinally along the guide 30 along the center thereof. A larger opening 120 is located at the top end of the guide 30 centrally between the opposite sides of the guide 30 and also extends through the inner folded edge portions of the flaps 62 and 72 and the panels 60 and 70 as well as the bridging panel 80 directly over the slider 46. The size of the openings 118 and 120 is selected to be sufficient to permit viewing of the fastener elements 42 and 44 and slider 46 as well as the edges of an article during positioning of the article edges over the fastening elements.

The member 56 has a longitudinal line of perforations 122 running through the top flap 62 and central panel 60 and running over the tape 34 along a desired line of stitching for the tape 34 while the member 58 has a longitudinal line of perforations 124 formed through the top flap 72 and center 70 and running over the tape 36 along a desired line of stitching for the tape 36. A bottom line of perforations 126 through the flaps 62 and 72, panels 60 and 70 and bridge panel 80 extends across the members 56 and 58 between the bottom ends of the lines 122 and 124 to the notch 110 below the bottom stop 48 along a desired line of bottom stitches for attaching the slide fastener to an article. Notches 128 and 130 through the flaps 62 and 72 and the panels 60 and 70 respectively, are formed in the top edges of the members 56 and 68 in line with the perforations 122 and 124. The perforations 122, 124 and 126 are illustrated as being small round holes close together so as to leave very little material between the perforations underneath the thread forming stitches attaching the tapes 34 and 36 to an article but far enough apart to maintain substantial stiffness and stability in mounting the slide fastener in an article.

The employment of the guide 30 in the installation of the slide fastener 32 in a garment indicated generally at 132 is illustrated in FIGS. 3–13. The garment 132 includes garment portions 134 and 136 which are initially sewn together along a seam 138 to a point 140 defining the bottom of an opening 142 in which a slide fastener is to be installed. The garment 132 is pressed along the seam 138 and the edge portions bordering the opening 142 to crease the seam allowance portions 144 and 146 back under the garment from the seam 138 and the inner edges 148 and 150 of the edge portions bordering the opening 142.

Figure 3:
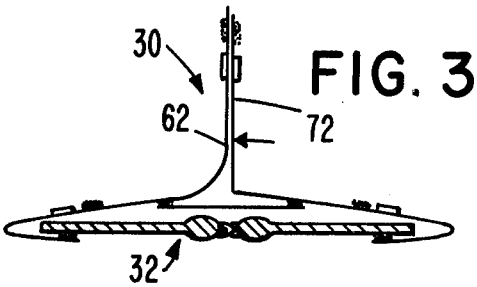
FIG. 3 is a cross-section view of the guide and fastener of FIG. 1 with upper folded halves of members of the guide in a raised position ready for insertion in the opening of an article.
Figure 4:
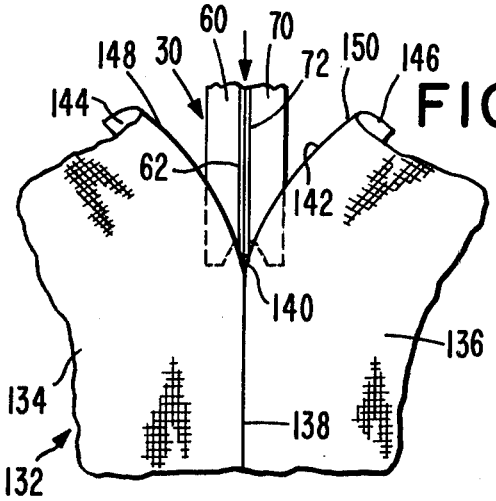
FIG. 4 is a plan view of the guide of FIG. 3 and an article showing the insertion of the guide into an opening of the article.
Figure 5:
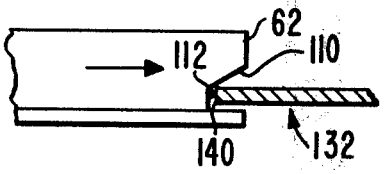
FIG. 5 is a side view of the guide and article of FIG. 4.
Figure 6:
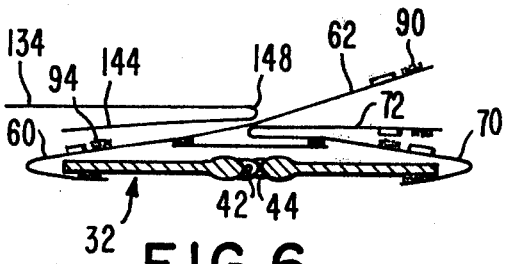
FIG. 6 is a cross section view of the guide, slide fastener and article of FIG. 4 during an attaching step for a first edge portion of the article to the guide.
Figure 7:
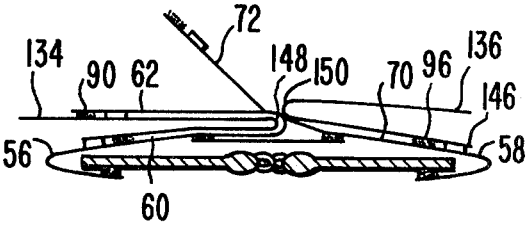
FIG. 7 is a view similar to FIG. 6 but during an attaching step for a secod edge portion of the article to the guide.

The top flaps 62 and 72 of the guide 30 are pulled from the central panels 60 and 70; the adhesive strips 90, 92, 94 and 96 are released by the release strips 102, 104, 106 and 108. The flaps 62 and 72 are pivoted upward and together to extend vertically as shown in FIG. 3. These vertically raised flaps 62 and 72 are inserted into the opening 142 with the top surfaces of the central panels 60 and 70 underlying the edge portions of the garment 132 bordering the opening 142 as shown in FIG. 4. The edge 112 of the notch 110 on the vertically extending flaps 62 and 72 forms a vertical abutment edge as shown in FIG. 5 for engaging the bottom 140 of the opening 142 to accurately position the bottom stop 48, FIG. 1, relative to the bottom of the opening 142. Subsequently the flap 72 is permitted to fold back toward the central panel 70 and the flap 62 is bent fully open as shown in FIG. 6. The edge 148 of the garment portion 134 bordering the opening in which the slide fastener is to be installed is then accurately located relative to the center of the coupling elements 42 and 44 by aligning such edge visually with the scored fold of flap 62 of guide 30. The garment portion 134 is pressed down over the pressure sensive adhesive strip 94 to attach the seam allowance 144 to the panel 60. Subsequently the flap 62 is bent over on top of the garment portion 134 and the flap 62 is pressed along the pressure sensive adhesive 90 to attach the garment portion 134 to the flap 62 as shown in FIG. 7. Thus the edge portion 134 is accurately secured relative to the slide fastener 32. In the event that the edge of the garment portion 134 is not at first properly aligned with the slide fastener 32, the flap 62 can be reopened pulling the garment portion 134 from the adhesive 90 and the seam allowance 144 can be lifted from the adhesive 94 permitting the edge portion 134 to be readjusted and reattached to the adhesive strips 90 and 94 to bring about proper alignment of the edge 148 relative to the slide fastener.

After the portion 134 has been properly attached to the guide member 56, the flap 72 of the guide member 58 is opened on top of the guide member 56. Guide members 56 and 58 are sufficiently flexible and resilient to permit the inner edge 64 of the member 56 to be bent upward allowing the inner edge 74 of the member 58 to be bent upward allowing the inner edge 74 of the member 58 to pass thereby and be positioned on top thereof. The flap 72 is then opened and the garment portion 136 is placed on the central panel 70 in position with the edge 150 aligned with the edge 148 of the portion 134. As shown in FIG. 8 the edge 148 of the portion 134 is clearly visible through the openings 118 and 120 permitting accurate placement of the edge 150 of the edge portion 136 on the central panel 70. Pressing the portion 136 over the adhesive strip 96 ataches the seam allowance 146 of the portion 136 to the adhesive 96. It is noted that the slider 46 is in the closed position of the slide fastener and that extra material from the portion 134 during the attachment of the portion 134 to the member 56 and from the portion 136 during attachment of the portion 136 to the member 70 is positioned over the slider 46 to insure that the slider 46 is covered by the edges of flaps 148 and 150 of the portions 134 and 136 of the garment 132. After proper positioning of the edge 150 on the central panel 170 relative to the edge 148, the flap 72 is folded downward into engagement with the portion 136 as shown in FIG. 9. Pressing of the flap 72 over the adhesive area 92 firmly secures the flap 72 to the portion 136. Again if the edge portions 148 and 150 are not properly aligned as viewed through the openings 118 and 120, the positioning of the portion 136 can be adjusted by pulling the adhesive 92 away from the portion 136 and by lifting the seam allowance 146 from the adhesive 96 to permit adjusting the position of the portion 136 and the edge 150 relative to the edge 148.

With the slide fastener temporarily secured in position by the guide 30 as shown in FIG. 10, the slide fastener 32 is sewn to the garment portions 136 and 134. A first line 152 of stitching begins at the upper end of the perforated line 124 and proceeds along the line 124 in the direction of arrow 153 toward the bottom of the slide fastener where the garment 132 is turned and a second line 154 of stitches is continued from the stitches 152 along the perforated line 126 at the bottom of the guide across the bottom portions of the tapes of the slide fastener 32 until it reaches the line 122. A further turning of the garment then permits a third line 156 of stitching to proceed up the left side of the guide along the perforated line 122 in the direction of arrow 157 to the top of the slide fastener to complete the sewing of the slide fastener to the garment 132. During this sewing the stitching 152, 154 and 156 relatively tight stitches due to the narrowness of the paper material left between perforations 124, 126 and 122; thus a tight stitching is made of the slide fastener 32 to the garment 132.

The removal of the guide 30 from the garment 132 after sewing is illustrated in FIGS. 11, 12 and 13. As shown in FIG. 11 the bottom flaps 66 and 76 together with their respective adhesive strips 86 and 88 (FIG. 2) are pulled away from the bottom sides of the tapes 34 and 36 of the slide fastener 32. These flaps 66 and 76 along with outer portions of the central panels 60 and 70 outside of the lines of stitches 152, 154, 156 are torn along the perforated lines 122, 124 and 126 beginning at the top end at notches 128 and 130 (FIG. 1). During this tearing, the adhesive strips 94 and 96 are pulled from the seam allowance portions of the garment 132. The outer portions of the upper flaps 62 and 72 outside of the lines of stitches 162, 164 and 166 together with the adhesive strips 90 and 92 are lifted from the garment 132 and torn along the perforated lines 122, 124 and 126 beginning at the notches 128 and 130. The notches 128 and 130 form an easily gripped corner which permits the tearing of the guide 30 along the perforated lines 122 and 124 to be easily started. After the bottom flaps 66 and 76 with the outer portions of the central panels 60 and 70 and top flaps 62 and 72 have been removed, the remaining portion of the guide 30 is removed by pulling upward from underneath the garment flaps formed by the inner sections of the garment portions 134 and 136 inside of the lines of stitching 152 and 156 as illustrated in FIG. 13.

Figure 14:
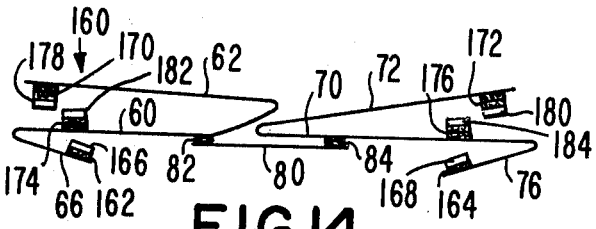
FIG. 14 is a cross-section view of a modified guide for installing a slide fastener in an article in accordance with the invention.

A variation, generally indicated at 160, of the guide without any slide fastener attached is shown in FIG. 14 wherein some parts are identified by the same numerals used to identify parts in the embodiment of FIGS. 1–13; such commonly identified parts having substantially similar structure and/or function. In the variation 160, adhesive strips 162 and 164 covered and protected by strips of release paper 166 and 168 replace the extruded adhesive strips 86 and 88 of FIG. 2, and double adhesive strips 170, 172, 174 and 176 covered and protected by respective release papers 178, 180, 182 and 184 replace the extruded strips of adhesive 90, 92, 94 and 96 and the associated release coatings 102, 104, 106 and 108 of FIG. 2. The adhesive strips 162 and 164 with their protective paper strips 166 and 168 are strips which are cut from roll or sheet adhesive with protective release paper such as that available from Avery International, Painesville, Ohio as FASSON Adhesive 445. In the strips 170, 172, 174 and 176, this FASSON adhesive No. 445 is used as a bottom layer to secure strips of paper coated on the outside with another adhesive protected by a silicone coated release paper. The outer layer of the double adhesive layers 170, 172, 174 and 176 with the associated release paper strips 178, 180, 182 and 184 are cut from sheets or rolls of adhesive paper commonly known as "sock label" such as FASSON adhesive sock label material No. S631 available from Avery International. The adhesive material in strips 162 and 164 forms a tenacious adhesive for securing the tapes of the slide fastener while the adhesive of the "sock label" material forming the outer layer of the double adhesive material 170, 172, 174, and 176 has much less tenacity to thus avoid damage to delicate garments.

A slide fastener is first installed in the guide 160 by positioning the slide fastener on the back or underneath side of the guide 160 with the bottom flaps 66 and 76 open. The release paper strips 166 and 168 are removed and then the flaps 66 and 76 are folded onto the slide fastener tapes pressing the flaps over the adhesive strips 162 and 164 to attach the slide fastener to the guide 160. The guide 160 with the temporarily attached slide fastener is installed in an article in a manner similar to that of FIGS. 1–13 except that the protective release papers 178, 180, 182 and 184 are removed before securing the adhesive strips 170, 172, 174 and 176 to the article edge portions.

Figure 15:
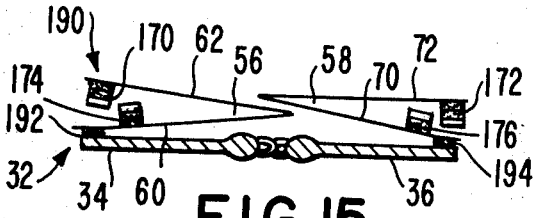
FIG. 15 is a cross-section view of another modified guide with attached slide fastener in accordance with the invention.
Figure 16:
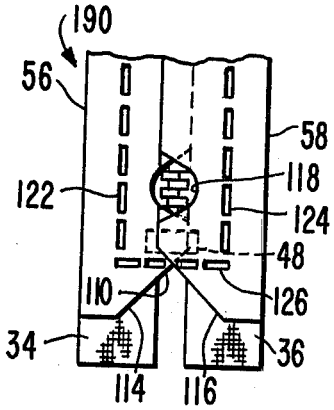
FIG. 16 is a plan view of the guide and slide fastener of FIG. 15.

A modified guide, indicated generally at 190 in FIGS. 15 and 16, has parts identified by numerals identifying parts having substantially similar structure and/or function in the embodiments of FIGS. 1–14. In the modified guide 190, the bottom flaps 66 and 76 and the bridge panel 80 of FIGS. 2 and 14 have been eliminated, and the panels 60 and 70 are secured to the slide fastener tapes 34 and 36 by adhesive strips 192 and 194 between the outer edge portion of the bottom surface of the panels 60 and 70 and the top surface of the outer edges of the tapes 34 and 36. Also the notch 110 is modified to be V-shaped by extending the angle cuts or edges 114 and 116 to the inner edges of the members 56 and 58. Additionally the perforations in lines 122, 124 and 126 are made with elongated narrow slit like openings rather than round openings. The adhesive 192 and 194 is made of the same material as the adhesive 162 and 164 of the embodiment of FIG. 14. The guide 190 with attached slide fastener 32 is installed in an article in substantially the same manner as described in connection with the embodiment of FIGS. 1 and 2. Tearing of the outer portions of panels 60 and 70 after sewing of the slide fastener 34 to the article is slightly more difficult than the embodiment shown in FIG. 11 since the flaps 66 and 76 render the embodiment of FIG. 11 easier to grasp.

Figure 17:
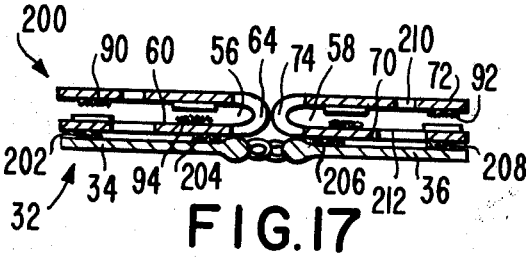
FIG. 17 is a view similar to FIG. 15 but showing still another modified guide for attaching a slide fastener to an article in accordance with the invention.
Figure 21:
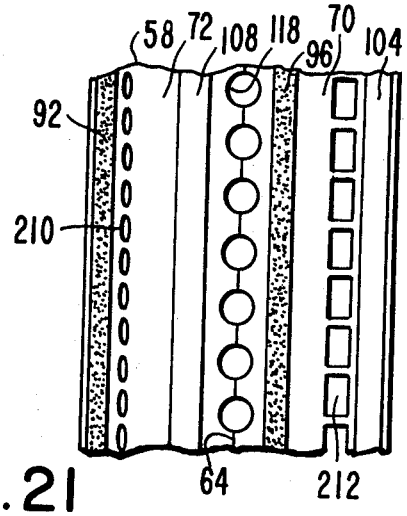
FIG. 21 is a plan view of one guide member of the guide of FIG. 17 in an unfolded position.
Figure 22:
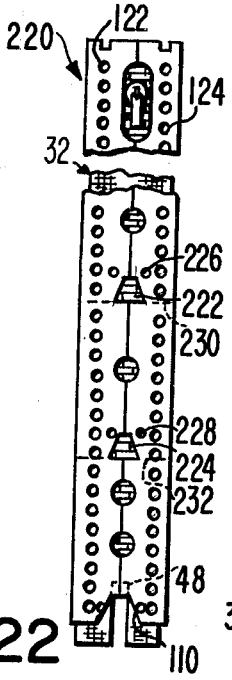
FIG. 22 is a plan view of a further modified guide with attached slide fastener in accordance with the invention.

Another modified guide generally indicated at 200 in FIG. 17 includes some parts identified by the same numbers identifying similar parts in the embodiments of FIGS. 1–16. The guide 200 is formed with the inner edges of score lines 64 or 74 of the respective members 56 and 58 in abutment rather than having the inner edge portions overlapping as in the embodiments of FIGS. 1–16. Further two spaced strips of adhesive 202 and 204 are used to attach the panel 60 to the tape 34 and two spaced adhesive strips 206 and 208 are used to attach the panel 70 of the member 58 to the tape 36. Each of the members 56 and 58 as shown for the member 58 in FIG. 21 has a line of long narrow perforations 210 in the top flap 72 and a line of larger wide openings 212 in the panel 70. The openings 210 are relatively narrow and elongated to form a sewing guide line as well as a tearing line for the outer portion of the top flap 72 while the bottom openings 212 in the panel 70 are relatively wide to avoid any possibility of misalignment of the openings 210 with the openings 212 and further form a very easily tearable line along the openings 212 with less material underneath the stitches formed in attaching the slide fastener to the tapes 34 and 36.

Figure 18:
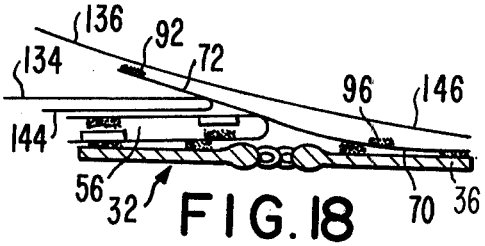
FIG. 18 is a view similar to FIG. 17 but during an initial step of a modified procedure for installing the guide and slide fastener in the article.
Figure 19:
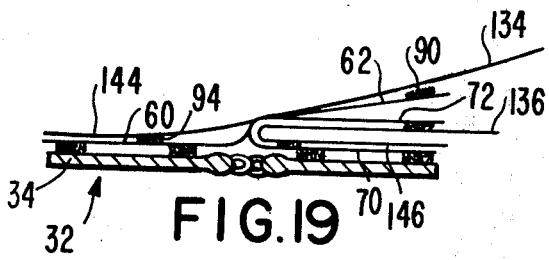
FIG. 19 is a view similar to FIG. 18 but at a later step in the modified procedure for installing a guide and slide fastener.
Figure 20:
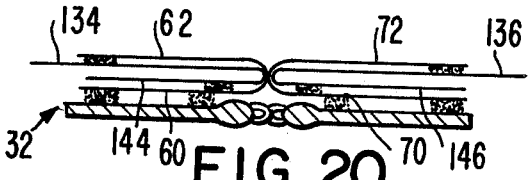
FIG. 20 is a view similar to FIGS. 17–19 but after completion of the temporary installation of the slide fastener in the article in preparation for sewing of the slide fastener through the article.

A modified procedure for installing the guide 200 and attached slide fastener 32 to an article 132 is illustrated in FIGS. 18, 19 and 20. The seam allowances 144 an 146 of the article to be installed are formed with a width equal to one half of the width of the slide fastener 32 and/or equal to the width of the respective panels 60 and 70. The garment or article is placed on top of the guide 200 with the opening between edge portions 134 and 136 generally aligned with the center of the guide. As shown in FIG. 18, the top flap 72 is opened on top of the portion 134 and member 56, and the portion 136 of the article is unfolded at its inner edge to extend over the open member 58 and garment portion 134. The edge of the seam allowance 146 is aligned with the right edge of the panel 70, or the tape 36, as illustrated in FIG. 18 and the seam allowance 146 is pressed against the adhesive 96 while the portion 136 is pressed against the adhesive 92 to secure the portion 136 to the member 58 of the guide 200. The top flap 72 with the attached portion 136 is then folded clockwise to the position shown in FIG. 19. The top flap 62 is opened on top of the member 58 while the garment portion 134 is likewise unfolded about its inner edge to the right to extend over the open member 56 and the garment portion 136. The edge of the seam allowance 144 is aligned with the left edge of the panel 60, or tape 34, as shown in FIG. 19 and the seam allowance 144 is pressed against the adhesive 94 while the garment portion 134 is pressed against the adhesive 90. Subsequently the garment portion 134 with the attached flap 62 is folded counterclockwise back to the position shown in FIG. 20 to complete the temporary installation of the guide 200 and the slide fastener 34 in the article. The slide fastener 32 can then be sewn to the article and the guide 200 removed from the sewn article and slide fastener in a manner similar to that described with the embodiments of FIGS. 15 and 16.

A further modified guide generally indicated at 220 with attached slide fastener 32 is similar to the embodiment shown in FIG. 1 except that trapezoidal openings 222 and 224 having a shape similar to the shape of the notch 110 are formed at two positions spaced at selected distances from the bottom of the slide fastener. Additionally perforated sewing and tear lines 226 and 228 are formed transversely across the guide 220 between the perforated lines 122 and 124 at the respective trapezoidal openings 222 and 224. Printed lines 230 and 232 are formed on the top surface of the guide 220 transversely across the guide at the bottom edge of the openings 222 and 224 for indicating lines along which the guide and slide fastener may be cut.

The guide 220 and slide fastener 222 is sold in a long length for example, 31 centimeters (12 inches), with the lines 230 and 232 marking shorter lengths, for example, 18 and 23 centimeters (7 and 9 inches). If a length of slide fastener of such shorter length is desired, the guide 220 and slide fastener 32 are cut along the line 230 or 232 corresponding to the desired length of the slide fastener. The cut slide fastener and guide can be installed in an article in the same manner as described for the embodiment of FIGS. 1–13. A new bottom stop may be applied to the bottom of the shorter length of slide fastener by the stitching lines forming the line along the perforated line 226 or 228, by a separate stop included with the guide 220 and slide fastener 32, or by a drop of adhesive or other chemical bonding means applied to the slide fastener elements in a position where a stop is desired. The number of trapezoidal openings may be less or may be more to provide various possible lengths. This permits the manufacture and marketing of only one length of the slide fastener to meet the needs of customers requiring various lengths of slide fastener.

Figure 23:
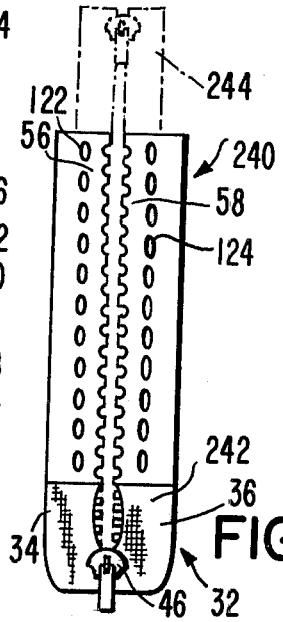
FIG. 23 is a plan view of a still further modified guide with attached slide fastener in accordance with the invention.

A still further modified guide 240 is illustrated in FIG. 23 with an attached slide fastener 32 having a portion 242 extending below the bottom of the guide 240 and supporting the slider 46 thereon. The coupling elements of the slide fastener 32 will not be interlocked above the portion 32 leaving the tapes 34 and 36 thereabove separated as well as the guide members 56 and 68 attached to such tapes. The guide members 56 and 58 with their attached tapes 34 and 36 are attached to the respective edge portions of an article and are sewn along the guide lines 122 and 124 in separate sewing operations. After sewing is completed along lines 122 and 124 and the guide members 56 and 58 removed, the slider 46 may be pulled up onto the slider 32 to close the slider. Thereafter the bottom portion 242 can be severed from the slide fastener, and a new bottom stop applied either by sewing across the bottom of the slide fastener above the severed line, by attaching a stop included with the slide fastener and guide 240, or by applying an adhesive or the like to form a bottom stop.

Alternately, an upper extension illustrated in phantom at 244 can be formed on the slide fastener 32 in place of the bottom extension 242. With an upper extension 244, the slide fastener can be installed in the closed position in one of the procedures described above in connection with the embodiments of FIGS. 1–20. Thereafter the slider can be moved downward and the upper portion 244 severed. Top stops on the elements would be made by sewing beads, applying a separate mechanical stop, or applying an adhesive or chemical material that hardens to form a stop.

Tests were conducted comparing the sewing of slide fasteners to garments by skilled seamstresses using a prior art method with the sewing of slide fasteners to garments using a guide in accordance with the invention. The prior art method employed was that printed on the package of a commercially available slide fastener and was substantially in accordance with the first prior art procedure described above. It was found that a semi-skilled seamstress using a guide in accordance with the invention could sew a slide fastener to a garment better or at least as good as a skilled seamstress using a prior art method.

In the prior art thin fabric in garments often resulted in wrinkles when sewn to a slide fastener in accordance with prior art method. The present guide and method eliminates such wrinkles or substantially reduces the chances of such wrinkles.

Further in the embodiments of the invention wherein the folded inner edges of the guide members are overlapped, the edge portions of the garment can be sewn to the slide fastener in a manner to produce flaps completely closing or hiding the slider and the slide fastener elements without any opening being left to expose such slider or slide fastener elements.

During the sewing of the slide fastener to an article using one of the above guides, the top flap portions 62 and 72 cover the material in the article preventing scuffing of the material as it is advanced through the sewing machine. In prior art processes when the slide fastener was sewn with the garment face downward, the feeding mechanism of the sewing machine often caused scuffing or damaged the material to which the slide fastener was being sewn.

Since the present invention is subject to many variations, modifications and changes in detail, it is intended that all matter described above and shown in the drawings be interpreted as illustrative and not in a limiting sense.

What is claimed is:

1. A device for use in sewing at least a portion of a slide fastener having a pair of carrier tapes to an article having an opening defined by edge portions on opposite sides thereof comprising a guide for extending along the article edge portions bordering opposite sides of the opening in the article, said guide having a width sufficient to extend over portions of both carrier tapes of the slide fastener, and having a length sufficient to extend along substantially the length of the slide fastener portion to be sewn to the article, said guide being substantially inelastic and stable in the width and length dimensions thereof, means for removably attaching the guide to both carrier tapes of the slide fastener, and means for removably attaching the edge portions of the article to the guide to mount the slide fastener on the article in position to be sewn to the article.

2. A device as claimed in claim 1 wherein the means for removably attaching the edge portions of the article to the guide includes strips of pressure sensitive adhesive mounted on the guide.

3. A device as claimed in claim 1 or 2 wherein the means for removably attaching the guide to the slide fastener includes strips of pressure sensitive adhesive mounted on the guide.

4. A device as claimed in claim 1 wherein the guide is generally planar.

5. A device as claimed in claim 4 wherein at least a portion of the guide is designed to extend between a portion of the slide fastener and a portion of the article.

6. A device for use in sewing a slide fastener having a pair of tapes to an article along an opening in the article, comprising a guide for extending along article edge portions bordering opposite sides of the opening in the article, means for removably attaching the guide to the slide fastener, means for removably attaching the edge portions of the article to the guide to mount the slide fastener on the article in position to be sewn to the article, and said guide including two members, each member including a panel extending between the respective edge portion and one slide fastener tape of the pair of slide fastener tapes, and each member including a top flap hinged on an inner edge of the respective panel for extending on top of the respective edge portion of the article.

7. A device as claimed in claim 6 wherein each member includes a bottom flap hinged on the outer edge of the panel for extending on the bottom side of the respective slide fastener tape.

8. A device as claimed in claim 7 wherein the means for removably attaching the guide to the slide fastener includes strips of a pressure-sensitive adhesive mounted on the bottom flaps for releasably attaching the bottom flaps to the respective slide fastener tapes.

9. A device as claimed in claim 6 wherein the means for removably attaching the guide for the slide fastener includes strips of a pressure sensitive adhesive mounted on the bottom surfaces of the panels of the respective members for securing to the top surfaces of the slide fastener tapes.

10. A device as claimed in claim 8 or 9 wherein the means for removably attaching the edge portions of the article to the guide include strips of a second pressure sensitive adhesive mounted on the bottom surfaces of the top flaps and on the top surfaces of the panels of the respective members for releasably attaching the edge portions of the article to the guide, said second pressure sensitive adhesive having substantially less tenacity than the first pressure sensitive adhesive forming the means for removably attaching the guide to the slide fastener.

11. A device as claimed in claim 6 including a bridge panel having opposite edge portions secured to the respective guide members to thus form a unitary guide.

12. A device as claimed in claim 6 including sewing guide line means formed on the top flaps for forming a guide along which stitching lines are to be sewn to attach a slide fastener to the edge portions of the article.

13. A device as claimed in claim 12 wherein the sewing guide line means includes perforated lines extending in the top flaps.

14. A device as claimed in claim 13 wherein the panels have a width designed to extend to at least the outer edges of the slide fastener tapes, and the perforated lines extend through the panels to permit sewing through the panels and tearing along the perforated lines.

15. A device as claimed in claim 14 including notch means formed at a top of the top flaps and panels for aiding in the tearing of the top flaps and panels along the perforated line.

16. A device as claimed in claim 6 wherein the inner edges of the two members have spaced openings formed therethrough forming windows through which elements of a slide fastener and inner edges of article edge portions may be viewed.

17. A device as claimed in claim 16 wherein the inner edge of one of the pair of guide members overlaps the inner edge of the other guide member.

18. A device as claimed in claim 16 or 17 including a larger opening formed in the inner edges of the pairs of members for viewing a slider and edge portions of an article for covering the slider.

19. A device as claimed in claim 6 including a notch formed in a bottom edge of the top flaps for engaging a bottom of the opening in the article to position the slide fastener relative to the opening.

20. A device as claimed in claims 11 or 19 wherein the members have openings formed through inner edges thereof for viewing inner edges of article portions and slide fastener elements, and wherein one of the inner edges of one of the pair of guide members overlaps the inner edge of the other of the pair of guide members.

21. A device as claimed in claim 19 wherein the notch is formed through the top flaps as well as the panels, and is defined by an upper edge extending perpendicular to the longitudinal dimension of the guide and angled edges extending downwardly and outwardly from the opposite ends of the upper edge.

22. A device as claimed in claim 1, 2, 5, 6, 7, 8, 9, 11, 12, 13, 14, 15, 16, 17, 19 or 21 wherein the guide is formed from a paper material.

23. A device as claimed in claim 1, 2, 5, 6, 7, 8, 9, 11, 12, 13, 14, 15, 16, 17, 19, or 21 wherein the guide is formed from a paper material having a thickness within the range from 0.127 millimeters to 0.21 millimeters in thickness.

24. A unit including a slide fastener for being sewn to an article having edge portions defining an opening therebetween, comprising a slide fastener having a pair of tapes and a plurality of interlocking elements mounted on the inner edges of the tapes, a guide formed from planar material extending along the slide fastener, said guide having a width sufficient to extend over substantial portions of both carrier tapes of the slide fastener and having a length sufficient to extend along substantially the length of the slide fastener portion to be sewn to the article, said guide being substantially inelastic and stable in the width and length dimensions thereof, means removably attaching the tapes of the slide fastener to the guide, and means on the guide for removably attaching the guide with the attached slide fastener to the edge portions of the article on opposite sides of the opening.

25. A unit as claimed in claim 24 wherein the means for removably attaching the tapes of the slide fastener to the guide, and the means on the guide for removably attaching the guide with attached slide fastener to edge portions of the article are respective strips of pressure sensitive adhesive.

26. A unit including a device and a slide fastener for being sewn to an article along an opening therein comprising, a slide fastener having a pair of tapes and a plurality of interlocking elements mounted on the inner edges of the tapes, a guide formed from planar material extending along the slide fastener, means removably attaching the tapes of the slide fastener to the guide, means on the guide for removably attaching the guide with attached slide fastener to edge portions of the article on opposite sides of the opening, and said guide including a pair of guide members, each member having a panel extending on top of a respective tape of the pair of tapes of the slide fastener, and each member having a top flap hinged on an inner edge of the respective panel for extending over the upper surface of an article edge portion.

27. A unit as claimed in claim 26 wherein each of the guide members includes a bottom flap hinged on an outer edge of the respective panel and extending underneath the respective tape of the slide fastener.

28. A unit as claimed in claim 27 wherein the means removably attaching the tapes of the slide fastener to the guide includes strips of adhesive mounted on the respective bottom flaps and adhering to the respective tapes.

29. A unit as claimed in claim 26 wherein the means removably attaching the tapes of the slide fastener to the guide include strips of pressure sensitive adhesive mounted on the bottom surfaces of the respective panels and adhering to the respective tapes of the slide fastener.

30. A unit as claimed in claim 26 wherein the top flaps of the pair of guide members each include a perforated line extending longitudinally thereof for forming a sewing line and for forming a tear line along which the top flaps may be torn.

31. A unit as claimed in claim 30 wherein the panels extend underneath the top flaps and include perforated lines aligned with the perforated sewing line in the top flap, and wherein there is included a bridge panel having outer edges bonded to the bottom side of the panels inside of the perforated lines thereon.

32. A unit as claimed in claim 26 wherein inner edge portions of the top flaps and panels have openings formed therethrough for permitting viewing of the interlocking elements of the slide fastener as well as article edges portions when inserted beneath the top flaps.

33. A unit as claimed in claim 32 wherein the inner edge portion of one of the pair of guide members overlaps the inner edge portion of the other guide member.

34. A unit as claimed in claim 26 or 32 wherein the guide members have a notch extending in the top flaps at the inner edges thereof for forming an abuttment edge to set the position of the unit relative to the bottom of an opening in which the slide fastener is to be installed.

35. A unit as claimed in claim 24, 25, 26, 27, 30, 31, 32 or 33 wherein the guide is a paper material.

36. A device for use in sewing a slide fastener to an article along an opening in the article, comprising a guide formed from a paper material having a thickness within the range from 0.127 millimeters to 0.210 millimeters in thickness for extending along article edge portions bordering opposite sides of the opening in the article, means for removably attaching the guide to the slide fastener, and means for removably attaching the edge portions of the article to the guide to mount the slide fastener on the article in position to be sewn to the article.

37. A device as claimed in claim 36, wherein at least a portion of the guide is designed to extend between a poriton of the slide fastener and a portion of the article.

38. A device for use in sewing a slide fastener to an article having edge portions defining an opening wherein the edge portions include body portions and seam allowance portions extending along the opening in the article, the device comprising a guide for extending along the edge portions of the article;

means for removably attaching the guide to the slide fastener; and means for removably attaching the edge portions of the article to the guide to mount the slide fastener on the article in position to be sewn to the article;

said means for removably attaching the edge portions of the article to the guide including first strip portions of pressure sensitive adhesive extending longitudinally on the guide for removably attaching the seam allowance portions of the article to the guide, and second strip portions of pressure sensitive adhesive extending longitudinally on the guide for removably attaching the body portions of the article to the guide.

39. A device as claimed in claim 38 wherein said guide includes a first portion for extending between the article and the slide fastener, and a second portion joined with the first portion for extending through the opening in the article and over the outside of the article; and said first strip portions of pressure sensitive adhesive are mounted on the second portion of the guide.

40. A device for use in sewing a slide fastener to an article having edge portions defining an opening in the article comprising a guide for extending along the edge portions in the article, means for removably attaching the guide to the slide fastener, and means for removably attaching the edge portions of the article to the guide to mount the slide fastener on the article in position to be sewn to the article, said guide including a line of perforations formed therein for extending in a sewing line.

41. A device for use in sewing a slide fastener to an article having edge portions defining an opening in the article comprising a guide for extending along the edge portions of the article;

means for removably attaching the guide to the slide fastener; and means for removably attaching the edge portions of the article to the guide to mount the slide fastener on the article in position to be sewn to the article whereby both of said attaching means cause the guide to remain in a fixed position relative to the slide fastener and the article edges during a sewing operation;

said guide including a first portion for extending between the article and the slide fastener, and a second portion joined with the first portion for extending through the opening in the article and over the outside of the article.

42. A device as claimed in claim 41 wherein said second portion of the guide includes sewing line guide means.

43. A device as claimed in claim 42 wherein said sewing line guide means includes a line of perforations.

44. A device as claimed in claim 42 or 43 wherein said first portion of the guide includes a line of perforations for extending in a sewing line.

45. A device for use in sewing a slide fastener to an article having edge portions defining an opening in the article, comprising a guide for extending along the edge portions of the article, first strips of a first pressure sensitive adhesive mounted on the guide for removably attaching the guide to the slide fastener, and second strips of a second pressure sensitive adhesive mounted on the guide for removably attaching the edge portions of the article to the guide to mount the slide fastener on the article in position to be sewn to the article, said second pressure sensitive adhesive having substantially less tenacity than the first pressure sensitive adhesive.

46. A device for use in sewing at least a portion of a slide fastener to an article having edge portions defining an opening wherein the slide fastener has a pair of carrier tapes with a pair of rows of interlocking coupling elements extending from inner edges of the respective tapes and a slider for opening and closing the coupling elements, the device comprising an integral guide having a width sufficient to extend over the rows of interlocking coupling elements and substantial portions of both carrier tapes of the slide fastener, and having a length sufficient to extend along substantially the length of the slide fastener portion to be sewn to article, means for removably attaching the slide fastener to one side of the guide, and means for removably attaching the edge portions of the article to the opposite side of the guide with the opening aligned with the slide fastener.

47. A device as claimed in 46 wherein the guide includes means for aiding the alignment of the article edge portions relative to the coupling elements on the opposite side of the guide.

48. A device as claimed in claim 47 wherein the aiding means includes opening means extending through the guide to expose the coupling elements.

49. A device as claimed in claim 36, 40, 41, 46, 47 or 48 wherein the means for removably attaching the edge portions of the article to the guide includes strips of pressure sensitive adhesive mounted on the guide.

50. A device as claimed in claim 36, 38, 40, 41, 46, 47 or 48 wherein the means for removably attaching the guide to the slide fastener includes strips of pressure sensitive adhesive mounted on the guide.

51. A device as claimed in claim 36, 38, 40, 41, 45, 46, 47 or 48 wherein the guide is generally planar.

52. A device as claimed in claim 36, 38, 41, 45, 46, 47 or 48 wherein said guide includes a line of perforations formed therein along a sewing line.

53. A device as claimed in claim 36, 41, 46, 47 or 48 wherein said means for removably attaching the edge portions of the article to the guide includes first strip portions of pressure sensitive adhesive extending longitudinally on the guide for removably attaching seam allowance portions of the article to the guide, and second strip portions of pressure sensitive adhesive extending longitudinally on the guide for removably attaching body portions of the article to the guide.

54. A device as claimed in claim 36, 45, 46, 47 or 48 wherein said guide includes a first portion for extending between the article and the slide fastener, and a second portion joined with the first portion for extending through the opening in the article and over the outside of the article.

55. A device as claimed in claim 36, 46, 47 or 48 wherein:

said means for removably attaching the edge portions of the article to the guide includes first strips of a first pressure sensitive adhesive mounted on the guide, and said means for removably attaching the guide to the slide fastener includes second strips of a second pressure sensitive adhesive mounted on the guide, the second pressure sensitive adhesive having substantially less tenacity than the first pressure sensitive adhesive.

56. A unit including a device and a slide fastener for being sewn to an article along an opening therein comprising a slide fastener having a pair of tapes and a plurality of interlocking elements mounted on the inner edges of the tapes, a guide formed from a planar paper material extending along the slide fastener, said paper material having a thickness within the range from 0.127 millimeters to 0.21 millimeters in thickness, means removably attaching the tapes of the slide fastener to the guide, and means on the guide for removably attaching the guide with the attached slide fastener to edge portions of the article on opposite sides of the opening.

57. A unit including a slide fastener for being sewn to an article having edge portions which include body portions and seam allowance portions, the edge portions defining an opening therebetween, the unit comprising a slide fastener having a pair of tapes and a plurality of interlocking elements mounted on the inner edges of the tapes, a guide formed from planar material extending along the slide fastener;

means removably attaching the tapes of the slide fastener to the guide; and means on the guide for removably attaching the guide with attached slide fastener to the edge portions of the article on opposite sides of the opening;

said means for removably attaching the edge portions of the article to the guide including first strip portions of pressure sensitive adhesive extending longitudinally on the guide for removably attaching the seam allowance portions of the article to the guide, and second strip portions of pressure sensitive adhesive extending longitudinally on the guide for removably attaching the body portions of the article to the guide.

58. A unit as claimed in claim 57 wherein said guide includes a first portion for extending between the article and the slide fastener, and a second portion joined with the first portion for extending through the opening in the article and over the outside of the article; and said first strip portions of pressure sensitive adhesive are mounted on the second portion of the guide.

59. A unit including a slide fastener for being sewn to an article having edge portions defining an opening therebetween comprising, a slide fastener having a pair of tapes and a plurality of interlocking elements mounted on the inner edges of the tapes, a guide formed from planar material extending along the slide fastener, means removably attaching the tapes of the slide fastener to the guide, and means on the guide for removably attaching the guide with attached slide fastener to the edge portions of the article on opposite sides of the opening, said guide including a line of perforations formed therein for extending in a sewing line.

60. A unit including a slide fastener for being sewn to an article having edge portions defining an opening therebetween comprising a slide fastener having a pair of tapes and a plurality of interlocking elements mounted on the inner edges of the tapes;

a guide formed from planar material extending along the slide fastener;

means removable attaching the tapes of the slide fastener to the guide; and means on the guide for removably attaching the guide with attached slide fastener to the edge portions of the article on opposite sides of the opening whereby both of said attaching means cause the guide to remain in a fixed position relative to the slide fastener and the article edges during a sewing operation said guide including a first portion for extending between the article and the slide fastener and a second portion joined with the first portion for extending through the opening in the article and over the outside of the article.

61. A unit as claimed in claim 60 wherein said second portion of the guide includes sewing line guide means.

62. A unit as claimed in claim 61 wherein said sewing line guide means includes a line of perforations.

63. A unit as claimed in claim 61 or 62 wherein said first portion of the guide includes a line of perforations for extending in a sewing line.

64. A unit including a slide fastener for being sewn to an article having edge portions defining an opening therebetween comprising a slide fastener having a pair of tapes and a plurality of interlocking elements mounted on the inner edges of the tapes, a guide formed from planar material extending along the slide fastener, first strips of a first pressure sensitive adhesive removably attaching the tapes of the slide fastener to the guide, and second strips of a second pressure sensitive adhesive mounted on the guide for removably attaching the guide with attached slide fastener to the edge portions of the article on opposite sides of the opening, said second pressure sensitive adhesive having substantially less tenacity than the first pressure sensitive adhesive.

65. A unit including a slide fastener for being sewn to an article having edge portions defining an opening therebetween comprising a slide fastener having a pair of carrier tapes and a plurality of interlocking elements mounted on the inner edges of the tapes, an integral guide having a width sufficient to extend over the rows of interlocking coupling elements and substantial portions of both carrier tapes of the slide fastener, and having a length sufficient to extend along substantially the length of the slide fastener to be sewn to article, means removably attaching the slide fastener to one side of the guide, and means for removably attaching the edge portions of the article to the opposite side of the guide with the opening over the slide fastener.

66. A unit as claimed in 65 wherein the guide includes means for aiding the alignment of the article edge portions relative to the coupling elements on the opposite side of the guide.

67. A unit as claimed in claim 66 wherein the aiding means includes opening means extending through the guide to expose the coupling elements.

68. A unit as claimed in claim 56, 57, 60, 64, 65 or 66 wherein said guide includes a line of perforations formed therein along a sewing line.

69. A unit as claimed in claim 56, 60, 65 or 66 wherein said means for removably attaching the edge portions of the article to the guide includes first strip portions of pressure sensitive adhesive extending longitudinally on the guide for removably attaching seam allowance portions of the article to the guide, and second strip portions of pressure sensitive adhesive extending longitudinally on the guide for removably attaching body portions of the article to the guide.

70. A unit as claimed in claim 56, 64, 65 or 66 wherein said guide includes a first portion for extending between the article and the slide fastener, and a second portion joined with the first portion for extending through the opening in the article and over the outside of the article.

71. A unit as claimed in claim 56, 65 or 66 wherein said means for removably attaching the edge portions of the article to the guide includes first strips of a first pressure sensitive adhesive mounted on the guide, and said means for removably attaching the guide to the slide fastener includes second strips of a second pressure sensitive adhesive mounted on the guide, the second pressure sensitive adhesive having substantially less tenacity than the first pressure sensitive adhesive.

72. A device for aiding in the sewing of a slide fastener to an article comprising a single guide having a longitudinal dimension adapted to be disposed along the slide fastener, a first pair of spaced strips of pressure sensitive adhesive mounted longitudinally on the guide for releasably attaching the guide to the slide fastener, and a second pair of spaced strips of pressure sensitive adhesive mounted longitudinally on the guide for releasably attaching the guide to the article.

73. A method of securing a slide fastener to an article along an opening in the article comprising the steps of removably attaching a guide to the slide fastener along the length thereof, removably attaching article edge portions to the guide on opposite sides of the opening in the article, sewing the edge portions of the article to the slide fastener, and removing the guide from the slide fastener and article edge portions, said step of removably attaching article edge portions to the guide including the folding of a pair of top flaps over the tops of the respective article edge portions and removably attaching such top flaps to the top surfaces of the article edge portions.

74. A method as claimed in claim 73 wherein the guide includes a planar portion and the slide fastener is removably attached to the guide on one side of the planar portion of the guide, and the article edge portions are removably attached to the guide on the opposite side of the planar portion.

75. A method as claimed in claim 74 wherein the sewing is performed along perforated lines in the top flaps of the guide, and the removing of the guide includes tearing of the top flaps along the perforated line to remove the guide.

76. A method as claimed in claim 75 wherein the sewing includes sewing through a perforated line in a panel of the guide between the edge portions of the article and the tapes of the slide fastener, and the removal of the guide includes tearing the panel along the perforated line therein.

77. A method as claimed in claim 36 wherein the step of removably attaching article edge portions to the guide includes pressing the article edge portions against first adhesive strips on panels of the guide extending between the article edge portions and the slide fastener tapes, and pressing the top flaps hinged on inner edges of the panels and having second adhesive strips against the top surfaces of the article edge portions.

78. A method as claimed in claim 73 wherein the article has seam allowances equal to the widths of respective center panels of guide members of the guide, the article edge portions are attached to the guide by sequentially unfolding the respective top flaps of the guide members to an open position extending over the opposite guide members, positioning the respective article portions unfolded from seam allowances thereof over the opposite garment portions, aligning the edges of the garment portions at the edges of the seam allowances with the outer edges of the respective center panels, pressing the seam allowances and edge portions of the garment against respective pressure sensitive adhesive strips on the center panels and the top flaps to secure the article edge portions to the guide members, and folding the top flaps of the guide members with the respective article portions to their correct positions.

79. A method as claimed in claim 73 wherein the article has seam allowances equal to one-half of the width of the slide fastener and the step of removably attaching article portions to the guide is performed by sequentially unfolding the respective top flaps of guide members to an open position extending over the opposite guide members, positioning the respective article portions unfolded from the seam allowance over the other article portion and the respective top flap, aligning the edges of the respective seam allowance portions with the edges of the slide fastener tapes, pressing the respective seam allowance portions and article portion against adhesive strips on top flaps and center panels of the respective guide members, and refolding the article portions and top flaps to folded positions for sewing the edge portions of the article to the slide fastener.

80. A method of securing a slide fastener to an article along an opening in the article comprising the steps of removably attaching a guide including a planar portion to the slide fastener along the length thereof to one side of the planar portion, aligning edge portions of the article through openings in the planar portion with coupling elements of the slide fastener, removably attaching article edge portions to the opposite sides of the planar portion of the guide on opposite sides of the opening in the article, sewing the edge portions of the article to the slide fastener, and removing the guide from the slide fastener and article edge portions after the sewing step.

81. A method of securing a slide fastener to an article along an opening in the article comprising the steps of removably attaching a guide to the slide fastener along the length thereof, removably attaching article edge portions to the guide on opposite sides of the opening in the article, sewing the edge portions of the article to the slide fastener along a line of perforations in the guide, and removing the guide from the slide fastener and article edge portions, said removing including tearing the guide along the line of perforations.

* * * * *